US005544924A

United States Patent [19]

Paster

[11] Patent Number: 5,544,924

[45] Date of Patent: Aug. 13, 1996

[54] SECURITY MECHANISM FOR SECURING A MOVABLE CLOSURE

[76] Inventor: Max Paster, P.O. Box 2052, Culver City, Calif. 90231

[21] Appl. No.: 188,577

[22] Filed: Jan. 28, 1994

[51] Int. Cl.[6] ..... E05C 5/00

[52] U.S. Cl. ..... 292/6; 160/201; 292/DIG. 36

[58] Field of Search ..... 292/6, 7, 56, 97, 292/64, 99, DIG. 25, DIG. 36; 49/199, 200, 280; 160/201

[56] References Cited

U.S. PATENT DOCUMENTS

| | | | |
|---|---|---|---|
| 1,549,505 | 8/1925 | Rasmussen | 292/DIG. 42 X |
| 3,103,995 | 9/1963 | Dugger | 49/200 |
| 3,714,735 | 2/1973 | Owen | 49/280 X |
| 4,442,631 | 4/1984 | Weber | 49/199 |
| 4,529,351 | 7/1985 | Olins | 292/31 X |
| 4,668,899 | 5/1987 | Ide | 318/380 |
| 4,739,584 | 4/1988 | Zellman | 49/199 |
| 4,794,732 | 1/1989 | Elardi | 49/280 |
| 4,805,344 | 2/1989 | Hrboka | 49/280 |
| 4,884,831 | 12/1989 | Emon | 292/38 |
| 4,996,795 | 3/1991 | Niswonger | 49/280 |
| 5,022,691 | 6/1991 | Clay, Jr. | 292/DIG. 36 X |

FOREIGN PATENT DOCUMENTS

| | | | |
|---|---|---|---|
| 5777073 | 1/1968 | Australia | 292/31 |
| 215466 | 5/1924 | United Kingdom | 292/31 |

*Primary Examiner*—Steven N. Meyers
*Assistant Examiner*—Monica E. Millner
*Attorney, Agent, or Firm*—Poms, Smith, Lande & Rose

[57] ABSTRACT

A security mechanism for securing a movable closure supported within a frame, the closure being movable from a secured position to a plurality of unsecured positions, preferably having a securing element having at least one opening, a base element, a slider element movably mounted on the base element and a latch element comprising at least one locking latch pivotally attached to the base element. The locking latch preferably has a first cam surface for engaging a cam post located on the slider element and a second cam surface for engaging the opening of the securing element. When the closure is moved to its secured position, the second cam surface of the locking latch engages the opening of the securing element thereby causing the locking latch to pivot and lock to the opening of the securing element. When the closure is moved to an unsecured position, the slider element is moved along the base element away from the securing element, causing the first cam post of the slider element to engage the first cam surface of the locking latch, causing the locking latch to pivot and disengage the opening of the securing element, thereby unsecuring the closure. The security mechanism may be used in conjunction with an automatic garage door opener for automatically securing and unsecuring a garage door that is opened and closed by the automatic garage door opener.

17 Claims, 5 Drawing Sheets

FIG. 1
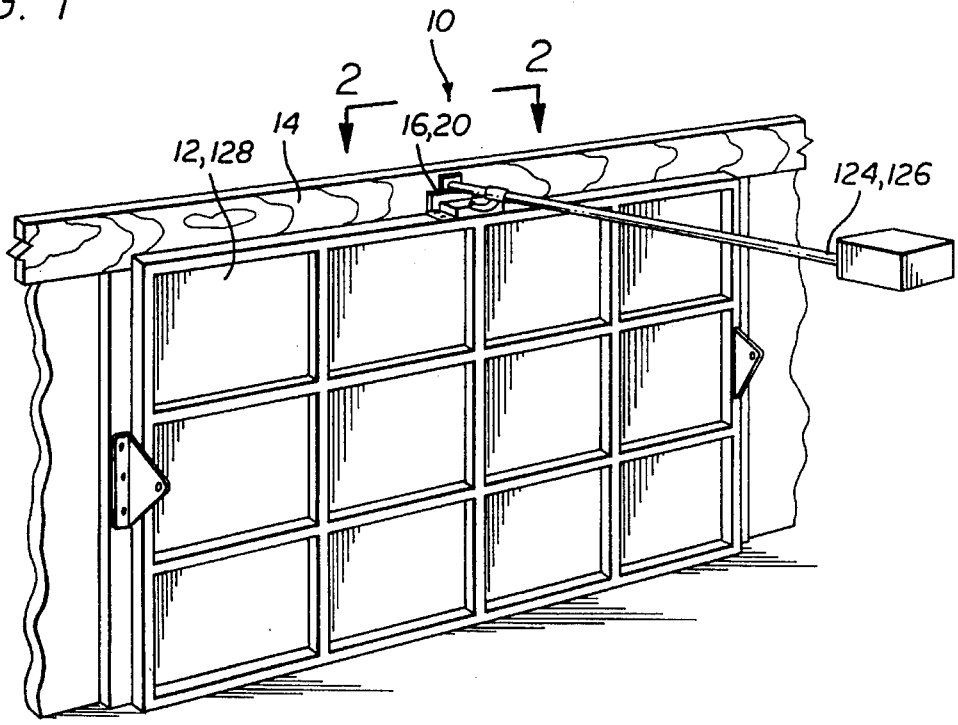
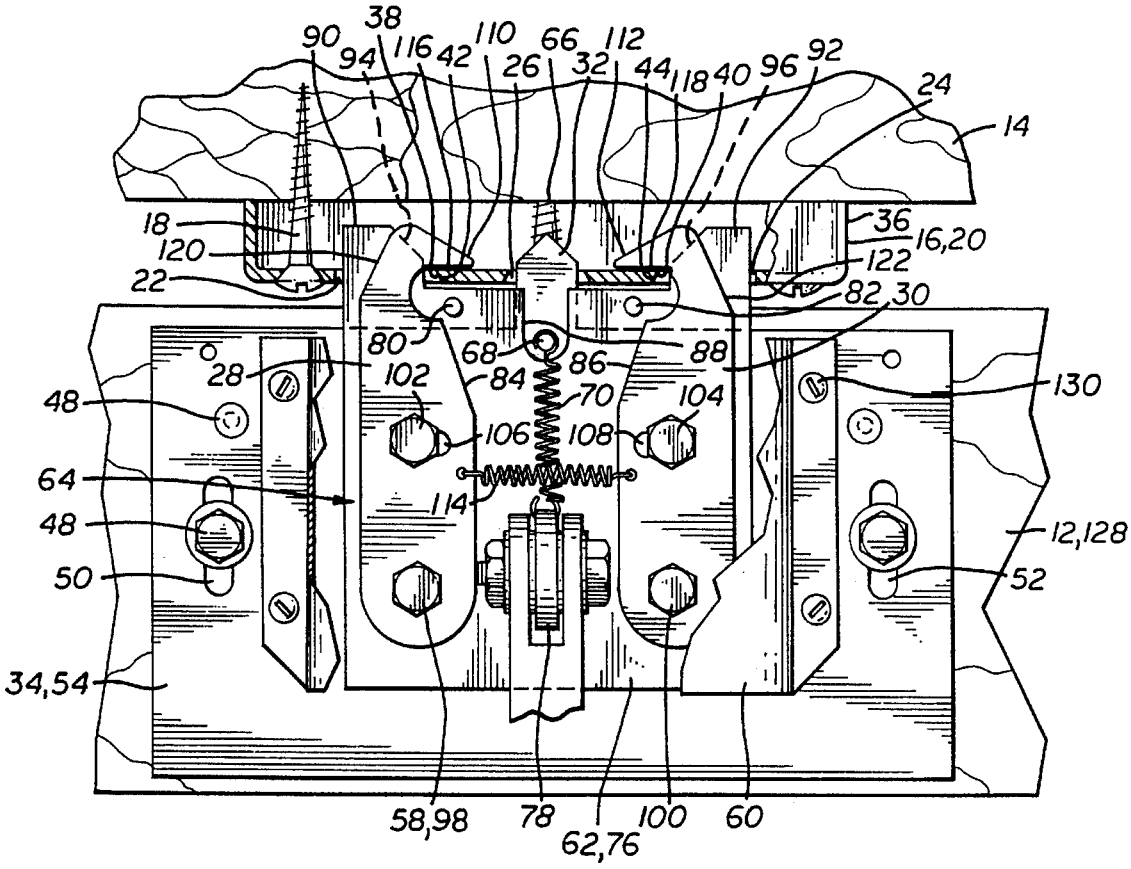
FIG. 2

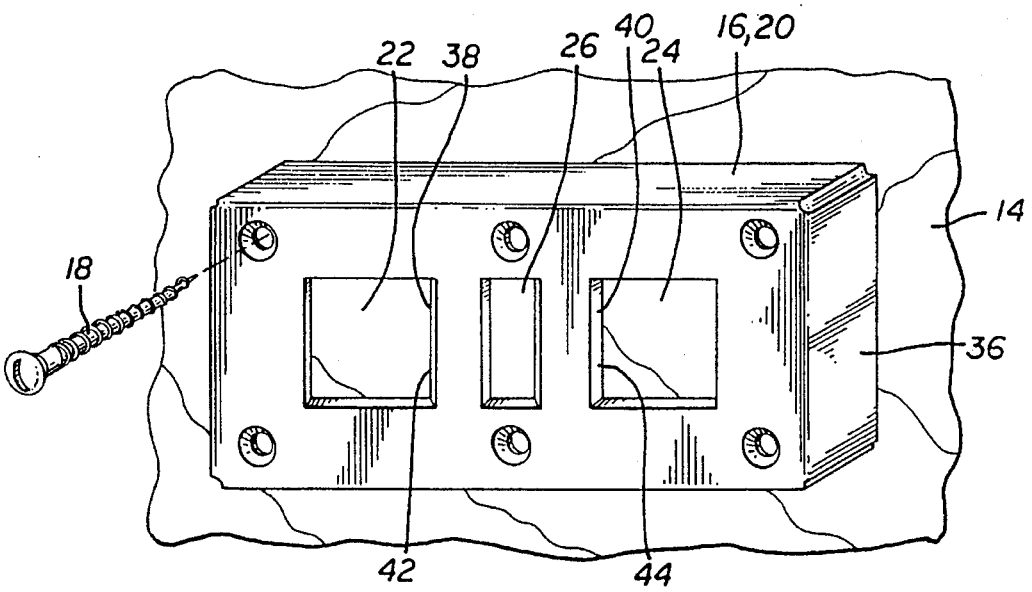
FIG. 4
FIG. 6
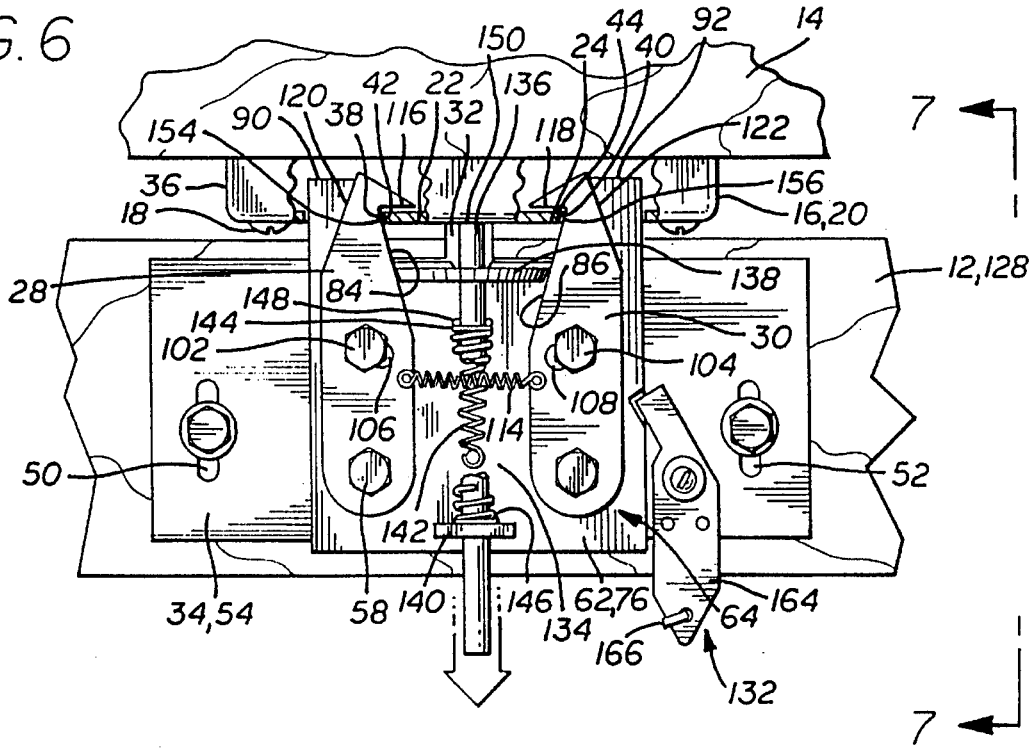

SECURITY MECHANISM FOR SECURING A MOVABLE CLOSURE

FIELD OF THE INVENTION

The present invention relates in general to security mechanisms and more particularly to security mechanisms for securing a movable closure such as a door to its support frame. The invention is applicable to movable closures that are connected to an opening mechanism for automatically moving the closure from its secured position to an unsecured position and to closures that are manually moved from their secured position to an unsecured position.

BACKGROUND OF THE INVENTION

With residential burglary and other crimes on the rise, residential security has likewise increased. The use of more and more elaborate locking, alarm and other security systems on residences has become commonplace. There is, however, one part of a residence where there have been relatively few advances in security—the garage. Garages are often connected to the residence by a door inside the garage. Once inside a garage, an intruder can easily make his way into the residence.

There are relatively few proven ways of protecting a garage from entry by intruders. Often, a residence that may be secured with sophisticated locks and alarms may have a garage that is only secured by a padlock on the garage. Padlocks or other locks often have proven insufficient to overcome the strength and/or ingenuity of an intruder. Further, garages having automatic garage door openers provide little security and often sacrifice security for convenience. Automatic garage door openers comprise chain-driven door openers, belt-driven door openers, and shaft-driven openers and the like. An intruder can open a garage door equipped with an automatic garage door opener with relative ease, since there is usually sufficient looseness in the various joints, the tracks/carriage/drive connections and the door construction itself to permit wedging of the door bottom and unauthorized entry.

Security mechanisms for garage doors are well known in the art. However, these security mechanisms have design characteristics that can be improved. For instance, conventional security mechanisms may not be attachable to a pre-existing garage door equipped with an automatic garage door opener. Further, conventional security mechanisms may not provide adequate security against an unauthorized entry. Other security mechanisms may be complex and require delicate adjustment and constant maintenance in order to function on a reliable, ongoing basis.

Accordingly, a principal object of the present invention is to provide a security mechanism for securing a movable closure supported within a support frame which provides security and is convenient to use.

Another object of the present invention is to provide a security mechanism for securing a closure supported within a support frame, the closure being automatically movable by a mechanical opening element.

A further object of the present invention is to provide a garage door security mechanism for securing a garage door to a garage door frame.

Another object of the present invention is to provide a garage door security mechanism for securing a garage door to a garage door frame, the garage door being movable by an automatic garage door opener which automatically secures and unsecures the garage door.

It is another object of the present invention to provide a safe, dependable, easy to install and use and inexpensive security mechanism for closures which works simultaneously and in conjunction with an existing mechanical opening element.

It is another object of this invention to provide a security mechanism for closures which prevents unauthorized entry by using a pivoting locking latch system.

Another object of the present invention is to provide a security mechanism for closures having mechanical opening elements which does not require major alterations to the existing automatic opening system.

Another object of the present invention is to provide a security mechanism for closures which does not require delicate adjustment and constant maintenance in order to function on a reliable, ongoing basis.

SUMMARY OF THE INVENTION

In accordance with the present invention, a security mechanism for securing a movable closure supported within a stationary support frame is provided which prevents unauthorized entry and which is safe, dependable, convenient, easy to install and use, does not require major alterations to the existing opening system, and does not require delicate adjustment and constant maintenance in order to function on a reliable, on-going basis. The foregoing objectives are obtained through a securing element having at least one opening, a base element, a slider element movably mounted on the base element and a latch element. The latch element comprises at least one locking latch pivotally attached to the base element.

The securing mechanism obtains its advantageous characteristics from its pivoting locking latch. The locking latch pivots and engages the opening of the securing element to secure the closure when the closure is moved to its secured position. Similarly, the locking latch pivots and disengages the opening of the securing element to unsecure the closure when the closure is moved to an unsecured position. The fact that the locking latch pivots permits the locking latch to engage the securing element even when the locking latch and the opening of the securing element are not perfectly aligned for engagement provides the advantage of allowing the closure to be easily secured and unsecured without delicate adjustments and constant maintenance.

In one preferred embodiment of a security mechanism for securing a movable closure, the locking latch pivots when the closure is moved to its unsecured position by the use of a first cam surface on the locking latch which engages with a first cam post on the slider element. When the closure is moved to an unsecured position, the slider element moves along the base element away from the securing element causing the first cam post of the slider element to engage the first cam surface of the locking latch causing the locking latch to pivot and disengage the opening of the securing element. It is this simple construction of a cam post and cam surface that provides the pivoting motion of the locking latch, thus allowing the locking latch to disengage the opening of the securing element even when the securing element and the locking latch are not perfectly aligned.

In yet another preferred embodiment, the locking latch pivots when the closure is moved to its secured position by the use of a second cam surface on the locking latch that engages with the opening of the securing element. When the closure is moved to its secured position, the second cam surface of the locking latch engages the opening of the securing element causing the locking latch to pivot and secure the locking latch to the opening of the securing element. The locking latch and the opening of the securing element therefore do not have to be precisely aligned for the security mechanism to consistently and properly operate. Thus, the pivoting locking latch having the first and second cam surfaces provides a simple design having the advantage of allowing the closure to be easily secured and unsecured without delicate adjustments and constant maintenance.

In a further preferred embodiment, the latch element comprises a first and second locking latch. In this preferred embodiment, the securing element has a first and second opening for engaging the first and second locking latches, respectively. Having a first and second locking latch provides further security by having two locking latches engaged with the openings of the securing element. The first and second locking latches are preferably coupled together by an elastic element. The elastic element is preferably a spring. The elastic element allows the locking latches to pivot, but returns the locking latches in a synchronous motion to their resting position by the pulling action of the elastic element. The elastic element holds the locking latches in place when they are engaged and locked to the openings of the securing element.

The first and second locking latches each preferably have a first and second cam surface. The slider element preferably has a first and second cam post for engaging the first cam surface of the first and second locking latches, respectively. The first and second locking latches pivot as described above. When the closure is moved to an unsecured position, the slider element moves along the base element away from the securing element causing the first and second cam posts of the slider element to engage the first cam surface of the first and second locking latches, respectively, causing the first and second locking latches to pivot and disengage the first and second openings of the securing element, respectively, to thereby unsecure the closure from the support structure. The locking latches also pivot when the closure is moved to its secured position by the use of a second cam surface that engages with the openings of the securing element. When the closure is moved to its secured position, the second cam surface of the first and second locking latches engage the opening of the securing element causing the locking latches to pivot and secure each locking latch to the first and second openings of the securing element, respectively. Thus, the first and second locking latches increase security while being capable of engaging the securing element even when the locking latches and the opening of the securing element are not perfectly aligned for engagement. The pivoting first and second locking latches therefore provide a simple and secure apparatus that prevents unauthorized entry, having the advantage of allowing the closure to be easily secured and unsecured without delicate adjustments and constant maintenance.

In another preferred embodiment, the slider element is coupled to a mechanical opening element. The mechanical opening element is capable of automatically moving the closure from a secured position to a plurality of unsecured positions and vice versa. The mechanical opening element is preferably an automatic garage door opener. In this preferred embodiment, the closure is a garage door and the support frame is the garage door frame. The automatic garage door opener is activated by a remote transmitter or switch that allows for opening and closing of the garage door by the user without having to exit from a motor vehicle. When the automatic garage door opener is activated, the garage door can automatically be moved from its secured position to an unsecured position or from an unsecured position to a secured position. Thus, a garage door having the security mechanism of the present invention that is connected to an automatic garage door opener has the advantage of being secured or unsecured without any additional steps by the user other than to activate the automatic garage door opener.

In yet another preferred embodiment of a security mechanism for securing a movable closure to its support frame, a closure which is movable by the user from a secured position to an unsecured position is provided. The closure is secured and unsecured by the use of a locking element and by the pivoting and engaging motion of the locking latch as described above.

Although the closure is preferably unsecured by a similar pivoting and engaging motion of the locking latch as described above, the movement of the slider element is provided by a locking element and an unlatching element. This locking element/unlatching element configuration also provides a simple apparatus for unsecuring the closure which does not require delicate adjustment and constant maintenance in order to function on a reliable, ongoing basis.

The locking element is preferably movable from a locked position to an unlocked position and is engaged to the slider element when the locking element is in its locked position. The unlatching element is moveable from a compressed position to a relaxed position and is mounted on the slider element by a first and second mounting post. The first mounting post has a first and second cam surface as described below.

The closure is moved from its secured position to its unsecured position by moving the locking element to its unlocked position. When the locking element moves to its unlocked position, the locking element disengages from the slider element thereby causing the unlatching element to release from its compressed position to its relaxed position. When the unlatching element moves to its relaxed position, the slider element moves along the base element away from the securing element. When the slider element moves along the base element away from the securing element, the locking latch pivots when the first cam surface of the locking latches engage the first and second cam surfaces of the first mounting post and disengages the opening of the securing element, as described above, to thereby allow the closure to be moved from its secured position to an unsecured position.

The closure is preferably moved from its unsecured position to its secured position by moving the closure from an opened position towards its closed position. When the closure reaches a position where the second cam surface of locking latches engages the inside edges of the openings of the securing plate, the locking latches pivot, engage and lock to the openings of the securing plate, as described above. At the same time, the unlatching rod engages the support frame and moves to its compressed position where it is releasably engaged to the support frame. The locking element is then moved to its locked position and engages the slider element.

Other objects, features, and advantages of the invention will become apparent from a consideration of the following detailed description and from the accompanying drawings.

BRIEF DESCRIPTION OF THE DRAWINGS

FIG. 1 is an elevational view of the security mechanism with which one embodiment of the present invention can be used showing the base element mounted to a garage door, the securing element mounted to the garage door frame and the slider element being coupled to an automatic garage door opener;

FIG. 2 is a top plan and partial cross sectional view taken along the line 2—2 in FIG. 1 showing a securing mechanism according to the present invention and showing the closure in its secured position;

FIG. 4 is a front elevational view taken along the line 4—4 in FIG. 3 showing the securing element according to the present invention;

FIG. 6 is a top plan and partial cross-sectional view showing a securing mechanism according to the present invention and showing the closure in its secured position and the locking element engaging the slider element;

DETAILED DESCRIPTION OF THE PREFERRED EMBODIMENTS

Figure 3:
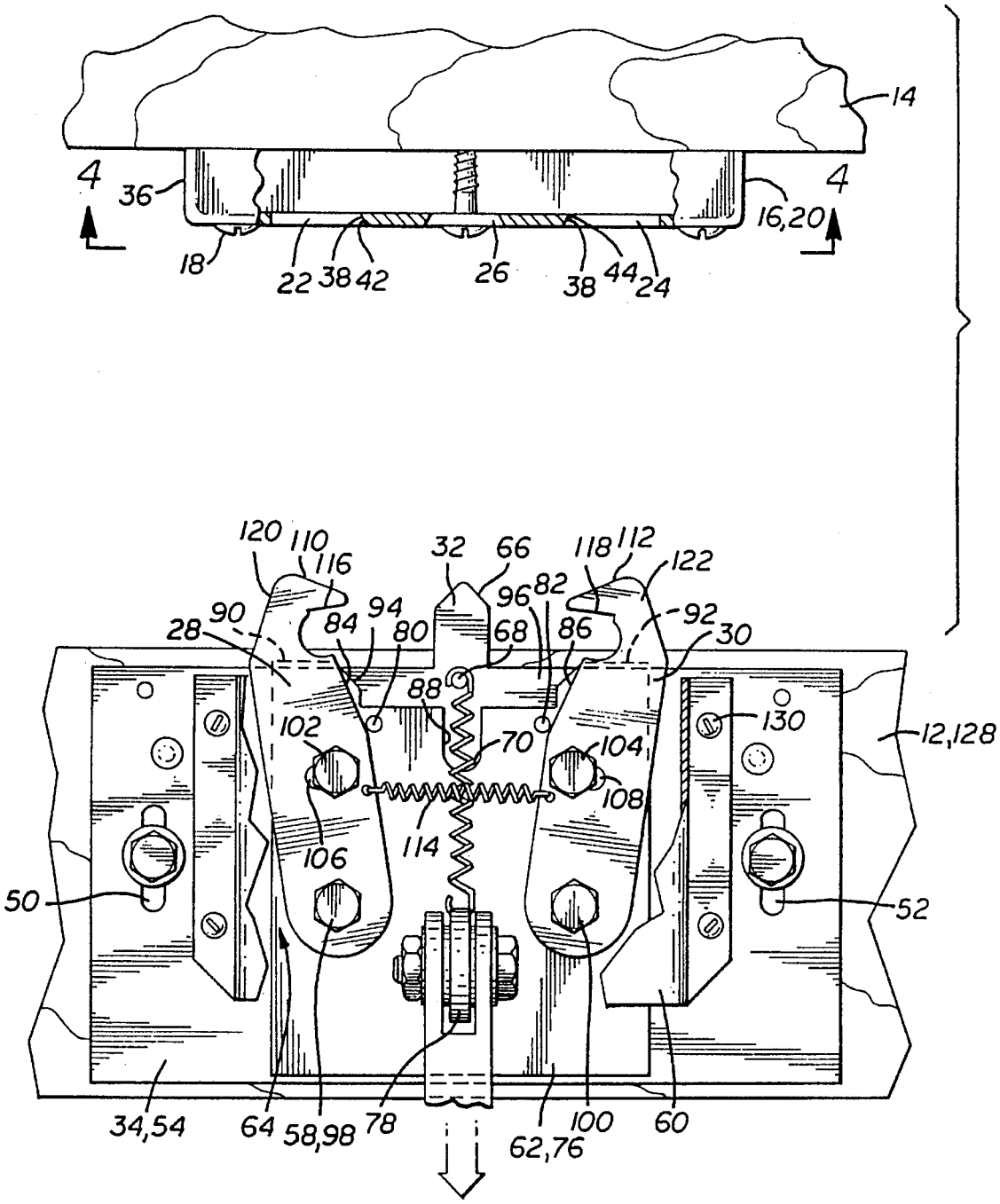
FIG. 3 is a top plan and partial cross sectional view similar to FIG. 2 showing the closure moving from its secured position to an unsecured position.

The present invention is embodied in a security mechanism for securing a movable closure which prevents unauthorized entry and which is safe, dependable, convenient, easy to install and use, does not require major alterations to the existing opening system, and does not require delicate adjustment and constant maintenance in order to function on a reliable, on-going basis. The security mechanism is suited for any type of closure that is supported within a stationary frame that is moved from a closed or secured position to an opened or unsecured position and vice versa.

In the particular embodiment shown in the drawings and herein described, the security mechanism 10 (see FIGS. 1–7*b*) is particularly suited for securing a movable closure 12 or door supported within a stationary support frame 14 (FIG. 1). The closure 12 is movable from a closed position to a plurality of opened positions. When the closure 12 is in its closed position (as shown in FIG. 1), the security mechanism of the present invention will secure the closure 12 and thus the closed position is hereinafter referred to as the secured position. When the closure 12 is in an opened position, the security mechanism does not secure the closure 12 and thus an opened position is hereinafter referred to as an unsecured position. The support frame 14 is of a size to support the closure 12. The closure 12 may be attached by hinges at any point on the support frame 14 or may be a rolling type closure such as a garage door or the like, as is well known to those skilled in the art. The closure 12 may be of any size.

In one preferred embodiment of the present invention, a securing element 16 is provided. (see FIGS. 2–4, 6, 7*a* and 7*b*). The securing element 16 is preferably mounted to the support frame 14 by screws or nails 18 so as to be easily mounted to most any existing frame 14. The securing element 16 is preferably a securing plate 20 which is formed from a lightweight metal that has high strength, such as steel, as is well known to those skilled in the art. All the elements of the security mechanism are preferably formed from lightweight, high strength metal. A lightweight, high strength metal is used to allow for easy installation and to provide a strong security mechanism to prevent unauthorized entry.

The securing plate 20 has at least one opening and preferably has three openings 22, 24 and 26 (See FIGS. 2–4, 6, 7*a* and 7B). A first opening 22 and a second opening 24 are provided to accept the locking latches 28 and 30 when they engage the first and second openings 22 and 24 of the securing plate 20, as described below. A third opening 26 for accepting the guide post 32 of the base element 34, as described below, is further provided on the securing plate 20. These openings 22, 24 and 26 are of a width and height that is larger than the locking latches 28 and 30 so that the locking latches 28 and 30 can pivot within the openings 22 and 24 and so that they may engage the openings 22 and 24. These larger openings permit the locking latches 28 and 30 to engage the openings 22 and 24 even if the locking latch and the opening are not perfectly aligned so that the security mechanism does not require delicate adjustment and constant maintenance.

Further, the securing plate 20 preferably has side walls 36 to give it depth so that it can accept the locking latches 28 and 30, again, to permit the locking latches 28 and 30 to engage the openings 22 and 24 even if not perfectly aligned. The inside edges 38 and 40 of the openings are preferably slanted to accept and engage the locking latches 28 and 30, respectively. (FIG. 3). These slanted edges provide cam surfaces 42 and 44 for engaging the locking latches 28 and 30, causing the locking latches 28 and 30 to pivot when the closure 12 is moved to its secured position.

A base element 34 is also provided. (see FIGS. 2, 3, 5 and 6). The base element 34 is preferably mounted to the edge of the closure 12 by bolts and/or nails 48 so as to be easily mounted to most any existing closure. The base element 34 is mounted to the closure at a position that is aligned with the securing plate 20 which has already been mounted to the supporting frame 14. For the reasons described below, the base element 34 does not have to be perfectly aligned with the securing plate 20. Slots 50 and 52 are provided to allow the base element 34 to be adjustably mounted to the edge of the closure 12 so that the base element 34 is mounted at the proper distance from the securing plate 20 to permit the locking latches 28 and 30 to lock to the securing plate 20, as described below.

Figure 5:
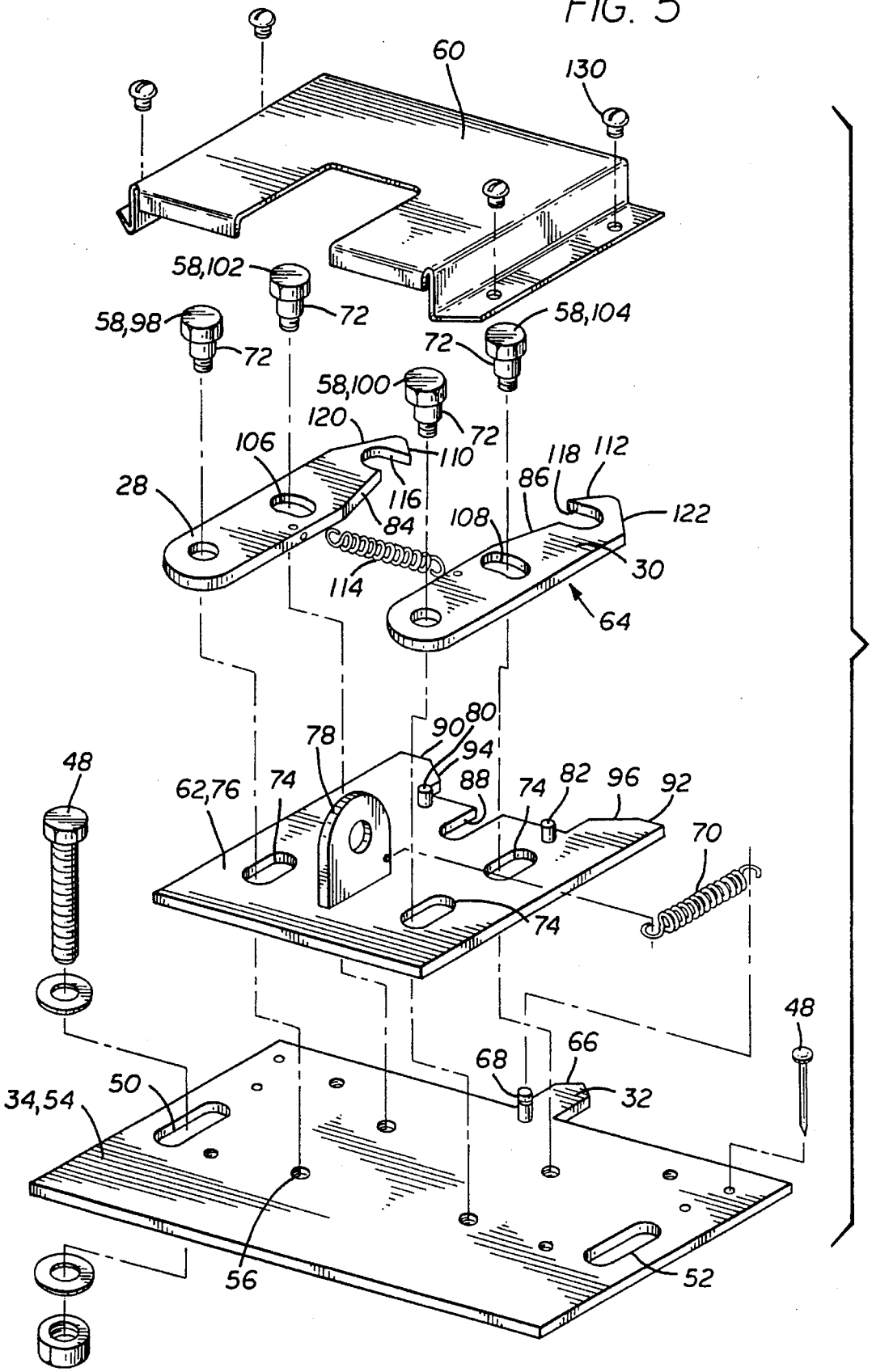
FIG. 5 is an exploded top elevational view showing the base element, the slider element and the locking element according to the present invention.

The base element 34 is preferably a base plate 54 which is formed from a lightweight metal that has high strength, such as steel, as is well known to those skilled in the art (See FIGS. 2, 3, 5 and 6). The base plate 54 preferably has a plurality of openings 56 to accept the rivets 58 that are used to mount the cover plate 60, slider element 62 and latch element 64, as described below. The base plate 54 also preferably has a guide post 32 protruding from its front edge. The guide post 32 has an angled front edge 66 for engaging the third opening 26 of the securing plate 20. The angled edge 66 of the guide post 32 engages the third opening 26 when the locking latches 28 and 30 are not perfectly aligned with the openings 22 and 24 of the securing plate 20. Thus, the guide post/third opening permits the closure 12 to be secured without delicate adjustments and constant maintenance. The base plate 54 also has a post 68 for securing one end of the elastic element 70 that couples the slider element 62 to the base plate 54, as described below (FIGS. 2, 3 and 5).

A slider element 62 is also provided. (FIGS. 2, 3, 5 and 6). The slider element 62 is preferably movably mounted to the base plate 54. Rivets 58 having a post section 72 are provided to pass through slots 74 on the slider element 62 and are attached to the base plate 54 at openings 56. The post section 72 is of such a width as to keep the slider element 62 and locking latches 28 and 30 mounted on the base while allowing them to move and pivot. The slots 74 are of such a length as to permit the slider element 62 to move along the base plate 54 away from the securing plate 20 a sufficient distance for the locking latches 28 and 30 to unlock and disengage the openings 22 and 24 of the securing plate 20.

The slider element is preferably a slider plate 76 which is formed from a lightweight metal that has high strength, such as steel, as is well known to those skilled in the art. The slider plate 76 preferably has a post 78 for attaching the elastic element 70 that couples the slider plate 76 to the base plate (FIGS. 2, 3 and 5). The elastic element 70 is preferably a spring. The elastic element 70 couples the slider plate 76 to the base plate 54 and controls the movement of the slider plate 76 as it is moved along the base plate 54 away from the securing plate 20.

The slider plate 76 also has at least one and, preferably, a first and second cam post 80 and 82, respectively. The first and second cam posts 80 and 82 engage the first cam surfaces 84 and 86 of the locking latches, as described below. The slider plate 76 also has a groove 88 permitting the slider plate 76 to slide past the post 68 of the base plate 54 for attaching the elastic element 70.

Further, the slider plate 76 preferably has a pair of projections, 90 and 92, for engaging the first and second openings 22 and 24 of the securing plate 20, respectively (See FIGS. 2, 3, 5 and 6). Projections 90 and 92 have cam surfaces 94 and 96, respectively, for guiding the projections 90 and 92 into the openings 22 and 24. The projections 90 and 92 serve two important purposes they guide the slider plate 26 into the openings 22 and 24 of the securing element 20 when the slider plate 76 is not perfectly aligned with securing plate 20 and they provide additional strength in securing the closure 12 thereby further preventing unauthorized entries into the closure 12 when it is in its secured position.

A latch element 64 is also provided. (FIGS. 2, 3, 5 and 6). The latch element 64 comprises at least one, and preferably a first and second locking latch, 28 and 30, respectively. The locking latches, 28 and 30, are pivotally attached to the base plate 54 by rivets 98, 100. The locking latches 28 and 30 pivot around the post section 72 of the rivets, 102 and 104. Rivets 102 and 104 pass through slots 106 and 108 on the slider plate 76 to permit the locking latches 28 and 30 to pivot in an arc defined by the slots 106 and 108. The locking latches 28 and 30 are preferably formed from a lightweight metal that has high strength, such as steel, as is well known to those skilled in the art.

Each locking latch 28 and 30 preferably has a first cam surface and a second cam surface, 84 and 110 on the first locking latch 28 and 86 and 112 on the second locking latch 30 (FIGS. 2, 3, 5 and 6). The first cam surface 84 and 86 of each locking latch 28 and 30 engages the cam posts 80 and 82 of the slider plate 76 when the slider plate 78 moves along the base plate 54 away from the securing plate 20, as described below. The first cam surface 84 of the first locking latch 28 engages the first cam post 80 of the slider plate 76 and the first cam surface 86 of the second locking latch 30 engages the second cam post 82 of the slider plate 76. When the slider plate 76 moves along the base plate 54 away from the securing plate 20 and the first cam surface 84 and 86 of the locking latches 28 and 30 engages the cam posts 80 and 82 of the slider plate 76, each locking latch 28 and 30 pivots in a direction away from each other as shown in FIG. 3. By pivoting this way, the locking latches 28 and 30 can disengage the securing plate 20 and thus the closure 12 can be moved to an unsecured position. It is this pivoting action by the locking latches 28 and 30 that provides the advantage of allowing the locking latches 28 and 30 to engage the openings 22 and 24 of the securing plate 20 even when the locking latches 28 and 30 are not perfectly aligned with the openings 22 and 24 of the securing plate 20.

Further, the locking latches 28 and 30 are preferably coupled together by an elastic element 114 attached to each locking latch 28 and 30 (FIGS. 2, 3, 5 and 6). The elastic element 114 is preferably a spring. The elastic element 114 allows the locking latches 28 and 30 to pivot, but returns the locking latches 28 and 30 in a synchronous motion to their resting position by the pulling action of the elastic element 114. By allowing the pivot motion, while returning the locking latches 28 and 30 to their starting position, the elastic element 14 permits the locking latches 28 and 30 to engage the openings 22 and 24 of the securing element 20 even when they are not perfectly aligned and provides even greater security by ensuring that the locking latches 28 and 30 fully engage the openings of the securing element 20. The elastic element 114 also holds the locking latches 28 and 30 in their locked position when they are locked to the securing plate 20.

Each of the locking latches 28 and 30 preferably has a second cam surface 110 on the first locking latch 28 and 112 on the second locking latch 30 (FIGS. 2, 3, 4, 5 and 6). The second cam surface 110 and 112 of each of the locking latches 28 and 30 engages one of the openings 22 and 24, respectively, of the securing plate 20 when the closure 12 is moved from an unsecured position to its secured position, the second cam surface 110 of the first locking latch 28 engaging the first opening 22 of the securing plate 20 and the second cam surface 112 of the second locking latch 20 engaging the second opening 24 of the securing plate 20. The second cam surfaces 110 and 112 of the locking latches 28 and 30 preferably engage the openings 22 and 24 of the slider plate 76 on their inside cam edges, 42 and 44. The second cam surfaces 110 and 112 of the locking latches 28 and 30 also provide the advantage that the locking latches 28 and 30 do not have to be perfectly aligned with the openings 22 and 28 of the securing plate 20 and thus the security mechanism does not require delicate adjustment and competent maintenance in order to function on a reliable, ongoing basis.

When the second cam surfaces 110 and 112 of the locking latches 28 and 30 engage the openings 22 and 24 of the securing plate 20, the locking latches 28 and 30 pivot and lock to the openings 22 and 24 of the securing plate 28 (FIGS. 2, 3, 4, 5 and 6). Each locking latch 28 and 30 preferably has a locking surface 116 on the first locking latch 28 and 118 on the second locking latch 30, for locking the locking latch 28 and 30 to the securing plate 20. The locking surface 116 and 118 provides a tight lock between the locking latches 28 and 30 and the securing plate 20 to prevent unauthorized entry into the closure 12 when it is in a secured position. The locking latches 28 and 30 preferably have a third cam surface 120 and 122 for guiding the locking latches 28 and 30 into the openings 22 and 24 of the securing plate 20 so that the locking latches 28 and 30 can engage the openings 22 and 24 of the securing plate 20 even when they are not perfectly aligned.

In another preferred embodiment of the security mechanism, a mechanical opening element 124 is coupled to the post 78 of the slider element (See FIGS. 1–5). A metallic cover plate 60 is coupled by screws 130 to the base plate 54 to protect the slider plate 76 and locking latches 28 and 30. The mechanical opening element 124 is preferably an automatic garage door opener 126, but it may be any system for opening a closure, as is well known to those skilled in the art. The automatic garage door openers that may be used are preferably chain-driven, belt-driven or shaft-driven door openers. The garage door opener 126 is preferably activated by a remote transmitter or switch to provide the convenience of the user not having to leave his motor vehicle to open the garage door. When the security mechanism is used in conjunction with a garage door having an automatic garage opener, the garage door is automatically secured and unsecured, i.e., no extra steps are necessary.

In this particular embodiment, the garage door 128 is moved from an unsecured position to a secured position as follows. The automatic garage door opener 126 is activated and moves the door 128 toward its closed position. When the door 128 approaches the securing plate 20, the second cam surface 110 and 112 of the locking latches 28 and 30 engages the cam surface 42 and 44 inside edge 38 and 40 of the openings 22 and 24 of the securing plate 20, causing the locking latches 28 and 30 to pivot outwardly away from each other. When the second cam surface 110 and 112 of the locking latches 28 and 30 has passed over the inside edge 38 and 40 of the opening 22 and 24, the locking surface 116 and 118 of the locking latches 28 and 30 enters the opening 22 and 24 and locks to the securing plate 20, thereby securing the door 128.

The garage door 128 is moved from its secured position to an unsecured position as follows. The automatic garage door opener 126 is activated and pulls on the slider plate 76 causing the slider plate 76 to move along the base plate 54 away from the securing plate 20. As the slider plate 76 moves, the first and second cam post 80 and 82, respectively, of the slider plate 76 each engage the first cam surface 84 and 86 of the first and second locking latches 28 and 30, respectively, causing the first and second locking latches 28 and 30 to pivot outwardly away from each other. The locking latches 28 and 30 pivot to a position where each locking surface 116 and 118 is released from the inside edge 38 and 40 of each opening 22 and 24 of the securing plate 20. It is this pivoting motion that permits the locking latches 28 and 30 to disengage the openings 22 and 24 of the securing plate 20 even when they are not in perfect alignment. As the garage door opener 126 pulls on the slider plate 76, the elastic element 70 coupling the slider plate 76 to the base plate 54 expands and pulls on the base plate 54 causing the door 128 to be moved to an opened position. As the door 128 moves, the locking latches 28 and 30 are pulled out from the securing plate 20. The elastic element 114 coupling the first and second locking latches 28 and 30 together then pulls the locking latches 28 and 30 so that they pivot and return to their starting position.

Figure 7B:
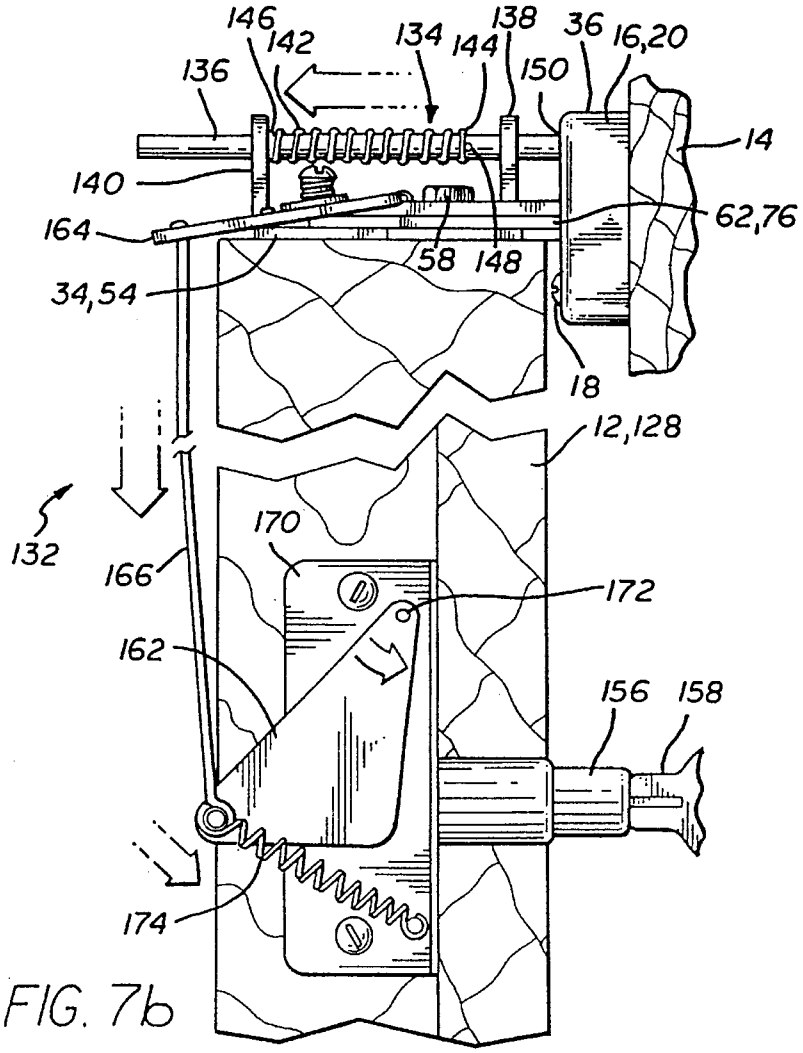
FIG. 7*b* is a side and partial cross-sectional view similar to FIG. 7*a* showing the locking element in its unlocked position and showing the closure being moved to an unsecured position.

In another preferred embodiment of the present invention, the closure 12 is movable by the user from a secured position to an unsecured position (See FIGS. 6–7*b*). The closure is secured and unsecured by the use of a locking element 132. In this preferred embodiment, the slider plate 76 is moved along the base plate 54 away from the securing plate 76 by the locking element 132 and the movement of an unlatching element 134. This locking element/unlatching element configuration also provides a simple apparatus for unsecuring the closure 12 which does not require delicate adjustment and constant maintenance in order to function on a reliable, ongoing basis.

The unlatching element 134 is movable from a compressed position to a relaxed position and vice versa (FIGS. 6–7*b*). The unlatching element. 134 preferably comprises an unlatching rod 136 mounted on the slider plate 76 by first and second mounting posts 138 and 140, respectively. The first mounting post has a cam surface 152 and 154 on each of its outside edges for engaging the first cam surfaces of the locking latches 28 and 30. These cam surfaces 152 and 154 have the same function as the cam posts 80 and 82 of the previously described preferred embodiment.

The unlatching rod 136 is surrounded by a spring 142 having a first and second end 144 and 146, respectively. The first end 144 of the spring 142 is engaged to pins 148 protruding from the unlatching rod 136 and the second end 146 of the spring 142 is engaged to the second mounting post 140. When the unlatching element 134 is in its compressed position, the first end 150 of the unlatching rod 136 is engaged with the support frame 14, thus compressing the spring 142 between its first end 144 and its second end 146. When the unlatching rod 136 moves from its compressed position to its relaxed position, the ends of the spring 142 force against the pins 148 of the unlatching rod 136 and against the second mounting post 140 causing the slider plate 76 to move away from the securing plate 20 thereby causing the locking latches 28 and 30 to pivot by the engagement of the cam surfaces 152 and 154 of the first mounting post 138 to the first cam surfaces 84 and 86 of the locking latches 28 and 30, as described above. Thus, the unlatching element 134 comprises a simple apparatus for moving the slider plate 76 along the base plate 54 away from the securing plate 20 when the closure 12 is moved from its secured position to its unsecured position.

Figure 7A:
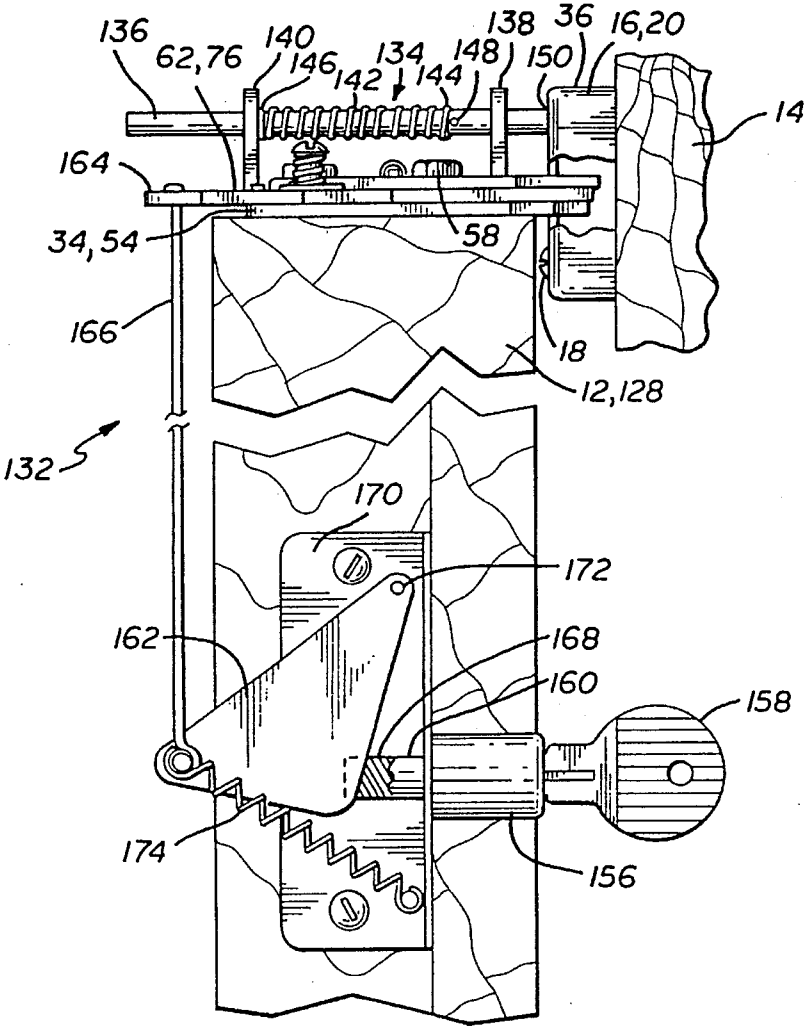
FIG. 7*a* is a side and partial cross-sectional view taken along the line 7—7 in FIG. 6 showing the closure in its secured position, the locking element in its locked position and the unlatching element in its compressed position.

The locking element is preferably movable from a locked position to an unlocked position. FIG. 7*a* shows the locking element 132 in its locked position. FIG. 7*b* shows the locking element 132 in its unlocked position. The locking element 132 preferably comprises a lock 156 (FIGS. 6–7*b*). The lock is preferably operated by a key 158. The lock 156 has a lock pin 160 moveable from an extended position to a contracted position, a pivoting lock plate 162, a locking lever 164, the locking lever being moveable from a first position to a second position and engaging the slider plate 76, and a cable 166, coupled to the lock plate 162 and to the locking lever 164. The locking element 132 is preferably mounted to the closure 12 by plate 170. The lock plate pivots on rivet 172 mounted to the plate 170. The lock plate 162 is coupled to the plate 170 by elastic element 174, which is preferably a spring. The lock 156 is mounted to the closure 12 so that the keyhole is on the outside of the closure.

The locking element 132 is in its locked position when the closure 12 is in its secured position (See FIG. 7*a*). When the locking element 132 is in its locked position, the lock pin 160 is in its extended position and engaged to the lock plate 162 at the groove 168 on the end of the lock pin 160. The locking lever 164 is in its first position and engaged to the slider plate 170 when the locking element 132 is in its locked position.

When the locking element 132 is moved to its unlocked position the closure may be moved from its secured position to an unsecured position. The key 158 is turned and the lock pin 160 moves to its contracted position thereby causing the elastic element 174 to pull on the lock plate 162, causing the lock plate 162 to pivot and thereby pull on the cable 166 causing the locking lever 164 to move to its second position and thereby disengage the slider plate 76. When the slider plate 76 is disengaged, the unlatching element 134 moves to its relaxed position, as described above, and causes the locking latches 28 and 30 to pivot and disengage the openings 22 and 24 of the securing plate 20 thereby allowing the closure to be moved to an unsecured position. Thus, the locking element 132 provides a simple apparatus for securing and unsecuring the closure allowing the user to move the closure to its secured and unsecured positions.

While a particular form of the invention has been illustrated and described, it will be apparent that various modifications can be made without departing from the scope of the invention. Accordingly, it is not intended that the invention be limited by the specific embodiment disclosed in the drawings and described in detail hereinabove.

It is claimed:

1. A security mechanism for securing a movable closure supported within a support frame, the closure being movable from a secured position to a plurality of unsecured positions, the security mechanism comprising;

a securing element having a first opening and a second opening:

a base element:

a slider element movably mounted on the base element, the slider element further including a first and a second cam post; and a latch element comprising a first and second locking latch, the first and second locking latches each being pivotally attached the base element, wherein the first locking latch includes a first cam surface wherein the first cam surface selectively contacts the first cam post of the slider element and wherein the second locking latch includes a first cam surface wherein the first cam surface of the second locking latch selectively contacts the second cam post of the slider element and wherein the first locking latch is coupled to the second locking latch by a spring and wherein the first locking hatch engages the first opening of the securing element and the second locking latch engages the second opening of the securing element.

2. A security mechanism for securing a movable closure supported within a support frame, the closure being movable from a secured position to a plurality of unsecured positions, the security mechanism comprising:

a securing element having a first opening and a second opening;

a base element;

a slider element movably mounted on the base element, the slider element further including a first and a second cam post; and a latch element comprising a first and second locking latch, the first and second locking latches each being pivotally attached to the base element, wherein the first locking latch includes a first cam surface wherein the first cam surface selectively contacts the first cam post of the slider element and wherein the second locking latch includes a first cam surface wherein the first cam surface of the second locking latch selectively contacts the second cam post of the slider element and wherein the first locking latch engages the first opening of the securing element and the second locking latch engages the second opening of the securing element.

3. A security mechanism for securing a movable closure supported within a support frame to the support frame, the closure being movable from a secured position to a plurality of unsecured positions, the security mechanism comprising:

a securing element having at least one edge defining at least one opening;

a base element;

a slider element movably mounted on the base element;

a latch element comprising at least one locking latch pivotally attached to the base element, wherein the latch element selectively engages and disengages an edge of an opening of the securing element;

an unlatching element movable from a compressed position to a relaxed position, wherein the latch element disengages the edge of the opening of the securing element when the unlatching element is moved from its compressed position to its relaxed position, the unlatching element being mounted on the slider element; and a locking element being movable from a locked position to an unlocked position and being engaged to the slider element when the locking element is in its locked position.

4. A security mechanism for securing a movable closure supported within a support frame to the support frame, the closure being movable from a secured position to a plurality of unsecured positions the security mechanism comprising:

a securing element having at least one edge defining at least one opening;

a base element:

a slider element movably mounted on the base element;

a latch element comprising at least one locking latch pivotally attached to the base element;

an unlatching element movable from a compressed position to a relaxed position, the unlatching dement being mounted on the slider element wherein the unlatching element comprises an unlatching rod mounted on the slider dement by first and second mounting posts and wherein the unlatching rod is surrounded by a spring, the spring having a first and second end, the first end of the spring being engaged to the unlatching rod and the second end of the spring being engaged to the second mounting post; and a locking element being movable from a locked position to an unlocked position and being engaged to the slider element when the locking element is in its locked position.

5. A security mechanism for securing a movable closure supported within a support frame to the support frame, the closure being movable from a secured position to a plurality of unsecured positions, the security mechanism comprising:

a securing element having at least one edge defining at least one opening;

a base element:

a slider element movably mounted on the base element:

a latch element comprising at least one locking latch pivotally attached to the base element;

an unlatching element movable from a compressed position to a relaxed position, the unlatching element being mounted on the slider element: and a locking element being movable from a locked position to an unlocked position and being engaged to the slider element when the locking element is in its locked position, wherein the locking element comprises a lock having a lock pin moveable from an extended position to a contracted position, a pivoting lock plate, a locking lever, the locking lever being moveable from a first position to a second position and releasably engaging the slider element, and a cable coupled to the lock plate and to the locking lever.

6. A Security mechanism for securing a movable closure supported within a support frame to the support frame, the closure being movable from a secured position to a plurality of unsecured positions, the security mechanism comprising:

a securing element having at least one edge defining at least one opening;

a base element:

a slider element movably mounted on the base element;

a latch element comprising at least one locking latch pivotally attached to the base element;

an unlatching element movable from a compressed position to a relaxed position, the unlatching element being mounted on the slider element; and a locking element being movable from a locked position to an unlocked position and being engaged to the slider element when the locking element is in its locked position, wherein the locking latch further includes a first cam surface and the unlatching element further includes at least one cam surface for engaging the first cam surface of the locking latch.

7. The security mechanism of claim 3 wherein the locking latch further includes a second cam surface for engaging the edge of the opening of the securing element.

8. The security mechanism of claim 3 wherein the locking latch has a locking surface for locking the locking latch to the opening of the securing element.

9. A security mechanism for securing a movable closure supported within a support frame to the support frame, the closure being movable from a secured position to a plurality of unsecured positions, the security mechanism comprising:

a securing element having at least one edge defining at least one opening;

a base element;

a slider element movably mounted on the base element and coupled to the base element by an elastic element;

a latch element comprising at least one locking latch pivotally attached to the base element;

an unlatching element movable from a compressed position to a relaxed position, the unlatching element being mounted on the slider element; and a locking element being movable from a locked position to an unlocked position and being engaged to the slider element when the locking element is in its locked position.

10. The security mechanism of claim 9 wherein the elastic element is a spring.

11. The security mechanism of claim 3 wherein the latch element comprises a first locking latch and a second locking latch and wherein, the securing element has a first opening and a second opening, the first locking latch engaging the first opening and the second locking latch engaging the second opening.

12. The security mechanism of claim 11 wherein the first locking latch is coupled to the second locking latch by an elastic element.

13. The security mechanism of claim 12 wherein the elastic element is a spring.

14. A security mechanism for securing a movable closure supported within a support frame to the support frame, the closure being movable from a secured position to a plurality of unsecured positions, the security mechanism comprising:

a securing element having a first opening and a second opening;

a base element:

a slider element movably mounted on the base element:

a latch element comprising a first locking latch and a second locking latch wherein the first and second locking latches are pivotally attached to the base element, wherein the first locking latch has a first cam surface and the second locking latch has a first cam surface, and wherein the first locking latch engages the first opening of the securing element and the second locking latch engages the second opening of the securing element;

an unlatching element movable from a compressed position to a relaxed position wherein the unlatching element is mounted on the slider element, and wherein the unlatching element has a first cam surface for engaging the first cam surface of the first locking latch and has a second cam surface for engaging the first cam surface of the second locking latch; and a locking element being movable from a locked position to an unlocked position and being engaged to the slider element when the locking element is in its locked position.

15. The security mechanism of claim 11 wherein the first locking latch further includes a second cam surface and the second locking latch further includes a second cam surface for engaging the first and second openings of the securing element, respectively.

16. The security mechanism of claim 11 wherein the first locking latch has a locking surface for locking the first locking latch to the first opening of the securing element and wherein the second locking latch has a locking surface for locking the second locking latch to the second opening of the securing element.

17. A security mechanism for securing a door to a door frame, the door being movable from a secured position to a plurality of unsecured positions, the security mechanism comprising:

a base plate;

a slider plate movably mounted on the base plate;

a first locking latch having a first cam surface and a second cam surface, the first locking latch being pivotally attached to the base plate, and a second locking latch having a first cam surface and a second cam surface, the second locking latch being pivotally attached to the base plate and the first locking latch being coupled to the second locking latch by an elastic element;

an unlatching rod releasable from a compressed position to a relaxed position, the unlatching rod being mounted on the base plate by a first mounting post, having a first and second cam surface for engaging the first cam surface of the first and second locking latches, and mounted on the slider plate by a second mounting post and wherein the unlatching rod is surrounded by a spring, the spring having a first and second end, the first end of the spring being engaged to the unlatching rod and the second end of the spring being engaged to the second mounting post, the unlatching rod being releasably engaged to the door frame when the door is in its closed position; and a locking element being movable from a locked position to an unlocked position and being engaged to the slider element when the locking element is in its locked position, the locking element comprising a lock having a lock pin moveable from an extended position to a contracted position, a pivoting lock plate, a locking lever moveable from a first position to a second position and engaging the slider element and a cable coupled to the lock plate and to the lever.

* * * * *